US011125020B2

(12) United States Patent
Downton et al.

(10) Patent No.: US 11,125,020 B2
(45) Date of Patent: Sep. 21, 2021

(54) DOWNHOLE DRILLING APPARATUS WITH DRILLING, STEERING, AND REAMING FUNCTIONS AND METHODS OF USE

(71) Applicant: Novatek IP, LLC, Provo, UT (US)

(72) Inventors: Geoffrey Charles Downton, Stonehouse (GB); Jonathan D. Marshall, Springville, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 104 days.

(21) Appl. No.: 16/372,863

(22) Filed: Apr. 2, 2019

(65) Prior Publication Data

US 2020/0318440 A1 Oct. 8, 2020

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/43; E21B 10/55
See application file for complete search history.

(56) References Cited

U.S. PATENT DOCUMENTS 2,715,552 A 8/1955 Lane
3,276,824 A 10/1966 Carter
4,549,613 A 10/1985 Case
7,159,668 B2 1/2007 Herrera
7,775,303 B2 8/2010 Goting
8,256,536 B2 9/2012 Harrison et al.
8,365,843 B2 2/2013 Hall et al.
2008/0000693 A1* 1/2008 Hutton ..... E21B 10/62 175/61
2012/0205163 A1* 8/2012 Azar ..... E21B 10/54 175/428
2017/0159370 A1* 6/2017 Evans ..... E21B 10/43
2017/0234071 A1* 8/2017 Spatz ..... E21B 10/567 175/61

* cited by examiner

*Primary Examiner* — Nicole Coy
*Assistant Examiner* — Yanick A Akaragwe

(57) ABSTRACT

A downhole drilling apparatus may comprise a rotatable body with various cutting elements connected thereto, some radially protruding therefrom, some radially extendable therefrom, and some revolvable relative thereto about a common axis. In operation, when the body is rotated, the radially protruding cutting elements may bore a generally cylindrical borehole. The radially extendable cutting elements may be extended during specific portions of the body's rotation to degrade certain areas of an inner wall of the borehole transforming it into a non-cylindrical borehole. At certain times, the revolvable cutting elements may be allowed to slide against the non-cylindrical inner wall while freely revolving to minimize disturbance to the borehole shape. At other times, revolution of these revolvable cutting elements may be restrained to ream the borehole back to a cylindrical shape.

19 Claims, 4 Drawing Sheets

DOWNHOLE DRILLING APPARATUS WITH DRILLING, STEERING, AND REAMING FUNCTIONS AND METHODS OF USE

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough earthen materials. As rotation continues the borehole may elongate and the drill bit may be fed into it on the end of a drill string.

At times it may be desirable to alter a direction of travel of the drill bit as it is forming a borehole. This may be to steer toward valuable resources or away from obstacles. A variety of techniques have been developed to accomplish such steering. One such technique comprises giving a borehole a cross-sectional shape that urges the drill bit in a lateral direction. For example, a cross-sectional shape comprising two circular arcs, one larger than the drill bit and one smaller, may urge the drill bit away from the smaller circular arc and into the open space provided by the larger circular arc.

Such a cross-sectional shape may be formed by an apparatus comprising one or more cutting elements radially extendable therefrom. Timed extension of the cutting elements, while the apparatus is rotating within a borehole, may allow them to degrade an inner wall of the borehole in certain places to create a non-cylindrical borehole shape. An abrasion-resistant gauge pad, protruding radially from the apparatus, may ride against this borehole inner wall to urge the apparatus sideways based on the borehole shape. Ideally, the gauge pad may ride without significantly wearing the gauge pad or damaging the borehole.

BRIEF DESCRIPTION

A downhole drilling apparatus may comprise a rotatable body with various cutting elements connected thereto. Specifically, the body may comprise one or more cutting elements radially protruding therefrom, one or more cutting elements radially extendable therefrom, and one or more cutting elements revolvable relative thereto about a common axis with the body. In operation, when the body is rotated, the radially protruding cutting elements may bore a generally cylindrical borehole within an earthen formation. The radially extendable cutting elements may be extended during specific portions of the body's rotation to degrade certain areas of an inner wall of the borehole. By so doing, the borehole may be transformed into a non-cylindrical shape.

The revolvable cutting elements may extend radially farther from the axis than the protruding cutting elements and from the extendable cutting elements when they are fully retracted. However, when fully extended, the extendable cutting elements may extend radially farther than the revolvable cutting elements. In such a configuration, the revolvable cutting elements may be allowed to slide against the non-cylindrical borehole shape while they are freely rotating. This free rotation may result in minimal disturbance to the borehole's cross-sectional shape during sliding. The sliding may cause the body to be urged laterally to form a curve in the borehole at it is being formed.

When it is desirable for the apparatus to form a straight borehole, or if the apparatus gets stuck in the borehole, a clutch or locking device may restrain the revolvable cutting elements from revolving relative to the body. When restrained in such a manner, the revolvable cutting elements may ream the borehole back to a cylindrical shape to remove the lateral urging. In most cases, the extendable cutting elements will be retracted during this reaming process.

DRAWINGS

FIG. 4-1 is a perspective view of an embodiment of a sleeve and clutch device that may form part of a drilling apparatus.

FIG. 4-2 is a perspective view of an embodiment of a sleeve and locking device that may form part of a drilling apparatus.

DETAILED DESCRIPTION

Figure 1:
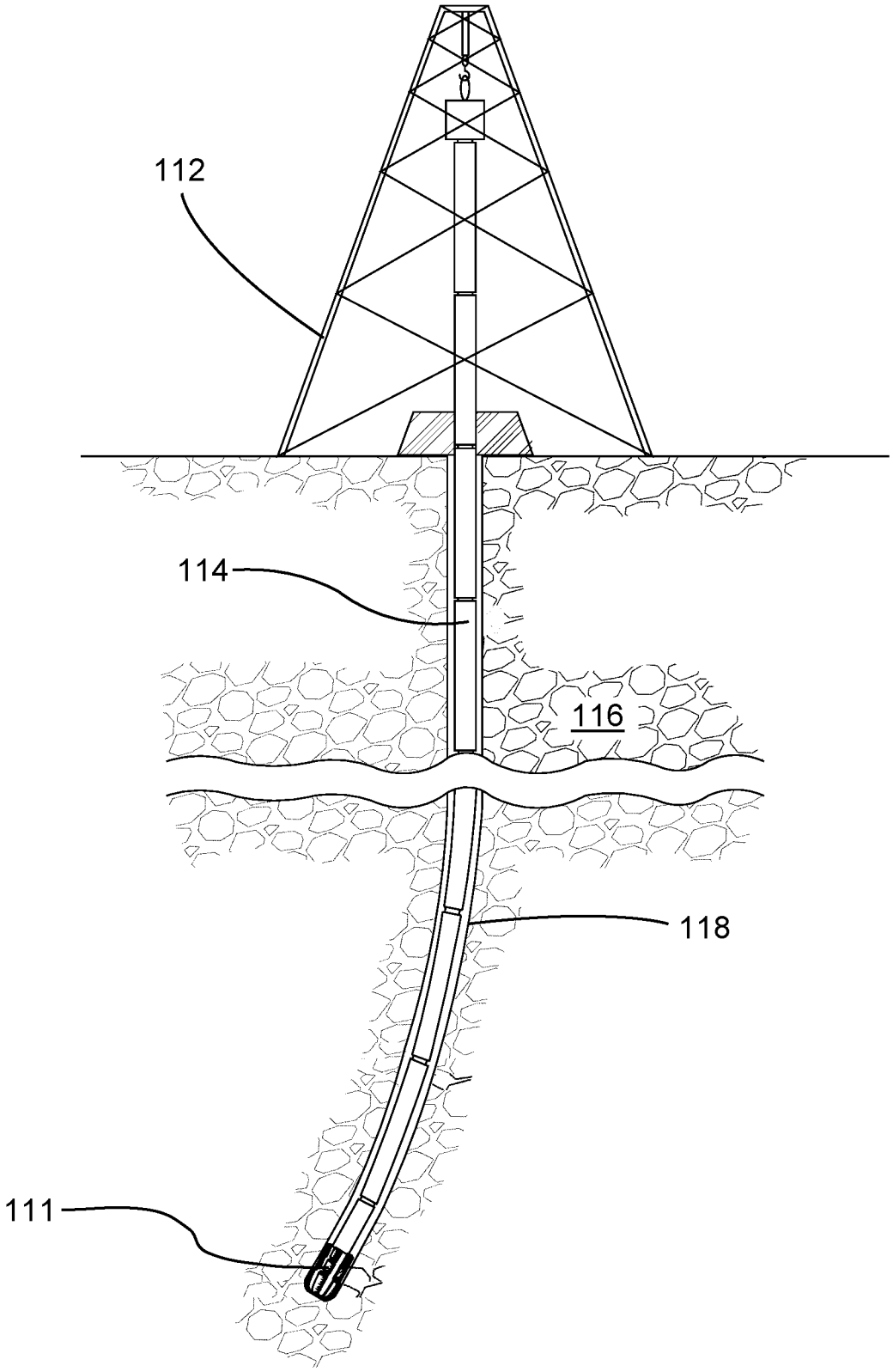
FIG. 1 is an orthogonal view of an embodiment of a subterranean drilling operation.

Referring now to the figures, FIG. 1 shows an embodiment of a subterranean drilling operation of the type commonly used to form boreholes in the earth. As part of this drilling operation, a drilling apparatus 111 may be suspended from a derrick 112 by a drill string 114 into a borehole 118 formed in a subterranean formation 116. While a land-based derrick 112 is depicted, comparable water-based structures are also common. Such a drill string 114 may be formed from a plurality of drill pipe sections fastened together end-to-end, as shown, or, alternately, a flexible tubing.

Figure 2:
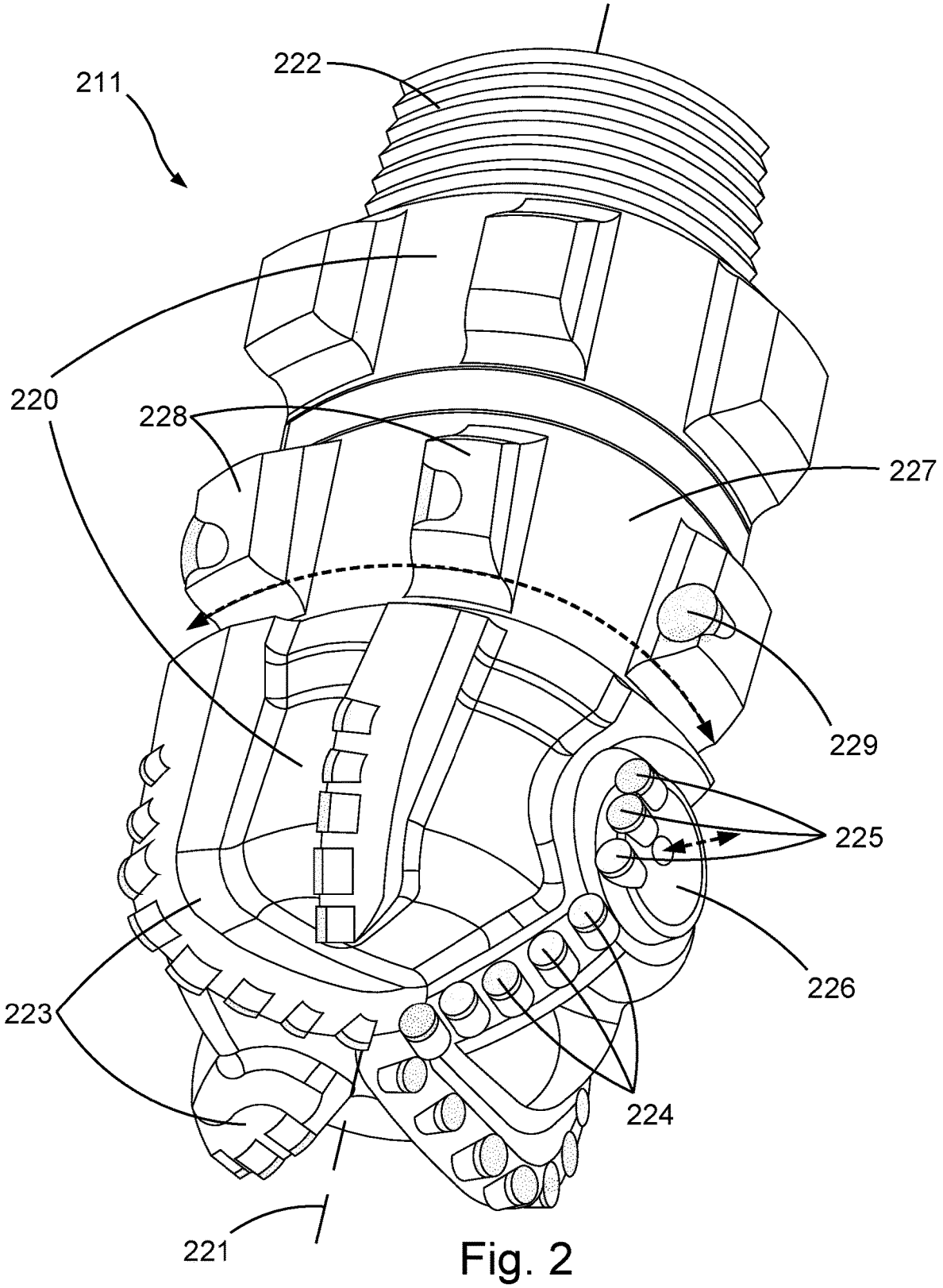
FIG. 2 is a perspective view of an embodiment of a drilling apparatus that may form part of a subterranean drilling operation.

FIG. 2 shows an embodiment of a downhole drilling apparatus 211 that may form part of a subterranean drilling operation as just described. This drilling apparatus 211 may comprise an elongated body 220, roughly cylindrical in shape and rotatable about an axis 221 passing longitudinally therethrough. The body 220 may comprise an attachment mechanism 222 disposed on one axial end thereof, allowing for the body 220 to be fastened to a distal end of a drill string as described previously.

Opposite from the attachment mechanism 222, the body 220 may comprise a plurality of bit blades 223 projecting both axially from one end of the body 220 and radially from a side thereof. These bit blades 223 may be spaced radially about the axis 221 and converge thereabout at the end. A plurality of fixed cutting elements 224 may be secured to each of the bit blades 223 such that they protrude from leading edges of each. The fixed cutting elements 224 may be formed of sufficiently tough materials to engage and degrade a subterranean formation, while the body 220 is rotated about the axis 221, to form a borehole therein. Due to their static positioning relative to the axis 221, these fixed cutting elements 224 may form a generally cylindrical borehole.

The body 220 may also comprise extendable cutting elements 225 that may be selectively extended radially from the body 220 to engage sections of the subterranean formation forming an inner wall of the borehole. If extended during only a portion of a full rotation of the body 220 and retracted for a remainder thereof, such extendable cutting elements 225 may transform the borehole's cylindrical nature and replace it with a cross-sectional shape comprising two distinct radii. In the embodiment shown, the extendable cutting elements 225 are secured to an exposed end of a translatable piston 226 that may extend or retract from a side of the body 220 via hydraulic pressure. However, any number of other mechanisms capable of producing a similar extension could also be used. As also shown, the piston 226 and extendable cutting elements 225 may be aligned with one of the bit blades 223 such that downhole fluids, often used in drilling operations, may flow freely past both the fixed cutting elements 224 and extendable cutting elements 225 in spaces in between the bit blades 223. However, such alignment is not essential as blade count and spacing can differ.

Revolvable cutting elements 229 may be secured to a hollow sleeve 227 encompassing the body 220 and free to rotate about the axis 221 relative to the body 220. These revolvable cutting elements 229 may extend radially farther from the axis 221 than the fixed cutting elements 224 described previously. To provide for this radial extension, while still allowing downhole fluids to pass, a plurality of revolvable blades 228, spaced radially about the axis 221, may project radially from the sleeve 227. The revolvable cutting elements 229 may be secured to the revolvable blades 228 such that they protrude from leading edges of each. In the embodiment shown, a single specimen of the revolvable cutting elements 229 is secured to each of the blades, however other arrangements are also possible.

With the revolvable cutting elements 229 extending radially farther than the fixed cutting elements 224, the revolvable cutting elements 229 may not fit within a cylindrically-shaped borehole formed by just the fixed cutting elements 224. As such, the extendable cutting elements 225 may need to be extended in certain areas to expand an internal radius of the borehole. Specifically, while the revolvable cutting elements 229 may extend radially farther from the axis 221 than these extendable cutting elements 225 when they are retracted, to expand the internal radius of the borehole such that the revolvable cutting elements 229 may pass through, the extendable cutting elements 225 may need to be extended radially beyond the revolvable cutting elements 229 when extended. The revolvable cutting elements 229 may then slide against an inner wall of the borehole whereby what remains of the original cylindrically-shaped borehole may urge the apparatus into the open space created by the extendable cutting elements 225. This urging may cause a drilling operation to veer off its previously set course and create a curve in the borehole as it is formed.

If allowed to freely rotate relative to the body 220, the revolvable cutting elements 229 may cause minimal disturbance to the borehole's new non-cylindrical shape. By gripping the inner wall of the borehole, the revolvable cutting elements 229 may tend to remain rotationally stationary with respect to the borehole while they slide. Such rotationally-stationary sliding may further protect the borehole's non-cylindrical shape from damage, which damage could reduce the lateral urgings that cause steering.

To drill straight, without the lateral urging or curving borehole, rotation of the sleeve 227 and revolvable cutting elements 229 relative to the body 220 may be restrained such that they all rotate in unison. While rotating in unison, torque acting on the body 220 may cause the revolvable cutting elements 229 to engage the inner wall of the borehole and ream the borehole to a diameter that clears non-cylindricality therefrom. The extendable cutting elements 225 may be retracted closer to the axis 221 than the revolvable cutting elements 229 during this process so as not to interfere. With the borehole once again comprising a generally cylindrical shape the boring operation may drill straight.

It is not uncommon for a drilling apparatus to become stuck in a borehole. This may be caused by the formation collapsing in on the apparatus or for other reasons. It is also possible that some dysfunction, such as cutting element damage, pressure loss or actuator failure, could inhibit the extendable cutting elements 225 from extending completely. If the body 220 were to become stuck in a borehole or the extendable cutting elements 225 failed to extend completely, a similar process of restraining relative rotation between the revolvable cutting elements 229 and the body 220 may be employed. In this arrangement, reaming by the revolvable cutting elements 229 of the borehole may free the body 220 of the apparatus and allow it to drill straight.

Figure 3:
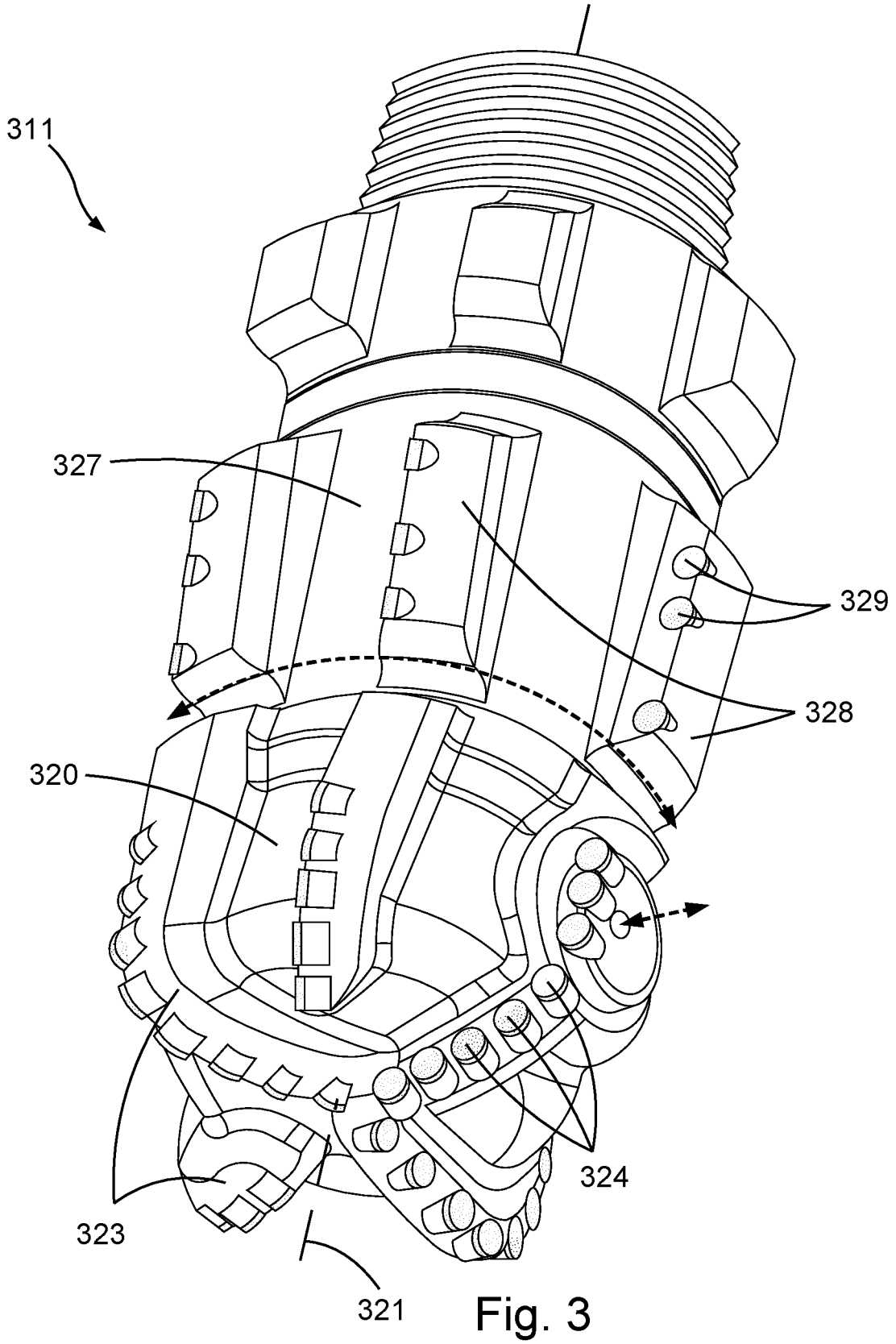
FIG. 3 is a perspective view of another embodiment of a drilling apparatus.

FIG. 3 shows another embodiment of a downhole drilling apparatus 311. In this embodiment, revolvable blades 328, projecting radially from a sleeve 327, may slope away from an axis 321 as they recede from bit blades 323 projecting axially and radially from a body 320. A plurality of revolvable cutting elements 329, as opposed to the single cutting element described earlier, may be secured to leading edges of each of the revolvable blades 328. As each of the revolvable blades 328 slopes away from the axis 321, each of the individual revolvable cutting elements 329 may extend radially farther from the axis 321. Furthermore, these revolvable cutting elements 329 may be staggered such that they are positioned at varied axial distances from one another. This axial staggering may prevent a group of the revolvable cutting elements 329 from falling into grooves formed by other revolvable cutting elements 329, leading to an uneven borehole inner wall. With sufficient staggering, this unevenness may be avoided regardless of what rate of penetration the apparatus 311 is passing through the borehole.

Figures 1, 4:
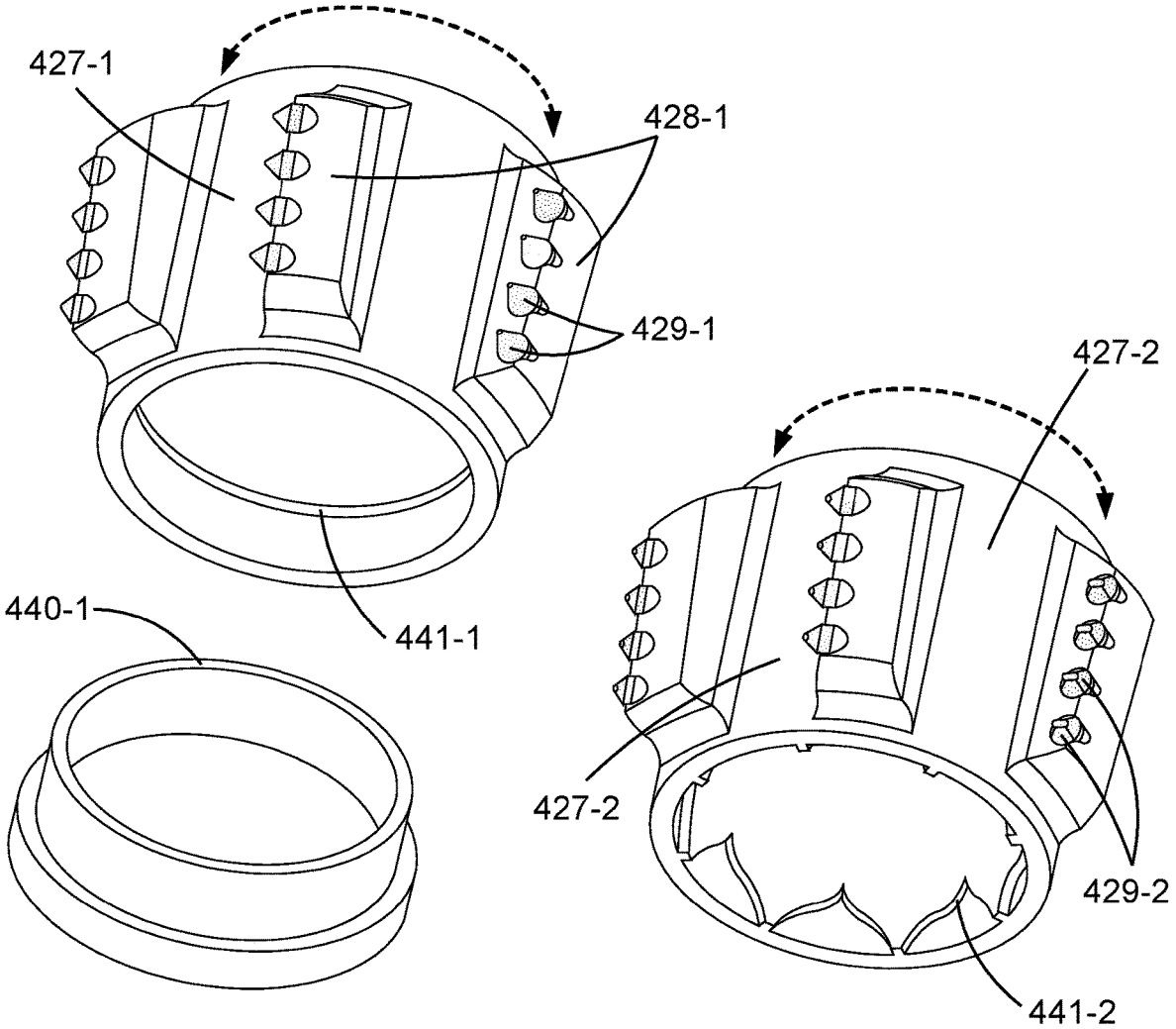
Figures 2, 4:
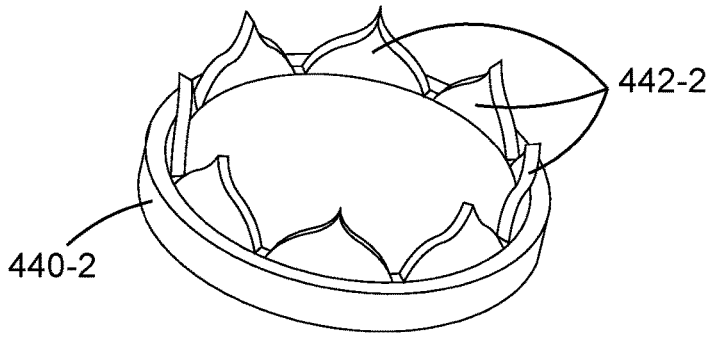

FIG. 4-1 shows an embodiment of a sleeve 427-1 that may form part of a subterranean drilling apparatus as just described. The sleeve 427-1 may comprise a plurality of revolvable blades 428-1 projecting radially therefrom with a plurality of revolvable cutting elements 429-1 secured to and protruding from leading edges of each. In this embodiment, the revolvable cutting elements 429-1 comprise generally pointed distal geometries. It is believed that, in certain arrangements, such three-dimensional distal geometries may aid in minimizing disturbance to a borehole cross-sectional shape while the sleeve 427-1 is freely rotating about a body (not shown) but still allow the revolvable cutting elements 429-1 to ream out non-cylindrical sections of such a borehole shape when rotationally fixed.

A clutch device 440-1 may be axially translatable relative to the sleeve 427-1 via hydraulic, pneumatic, mechanic or any other means. When translated, at least one surface of the clutch device 440-1 may engage a surface 441-1 of the sleeve 427-1 to restrict it from free rotation. It is believed that such a clutch device 440-1 may hinder rotation of the sleeve 427-1 while permitting some rotation if desirable to reduce strain on the drilling apparatus.

FIG. 4-2 shows another embodiment of revolvable cutting elements 429-2 secured to a sleeve 427-2. In this embodiment, the revolvable cutting elements 429-2 each comprise a three-dimensional blade geometry. In addition, a locking device 440-2 comprising a plurality of teeth 442-2 protruding therefrom may be axially translated relative to the sleeve 427-2. The teeth 442-2 of the locking device 440-2 may engage mating surfaces 441-2 of the sleeve 427-2 to rotationally fix the sleeve 427-2 to the locking device 440-2. While a variety of different shapes would be suitable for their purpose, in the embodiment shown, the teeth 442-2 and mating surfaces 441-2 comprise geometries such that their interaction also rotationally align the sleeve 427-2 relative to the locking device 440-2.

Whereas this discussion has revolved around the drawings attached hereto, it should be understood that other and further modifications apart from those shown or suggested herein, may be made within the scope and spirit of the present disclosure.

The invention claimed is:

1. A downhole drilling assembly, comprising:

a body rotatable about an axis;

one or more first cutting elements radially protruding from the body;

one or more second cutting elements radially extendable from the body;

one or more third cutting elements revolvable about the axis, relative to the body; and a clutch or locking device capable of rotationally fixing the third cutting elements to the body, wherein the one or more third cutting elements are freely revolvable about the axis when not fixed by the clutch or locking device.

2. The downhole drilling assembly of claim 1, wherein the one or more third cutting elements are secured to a sleeve encompassing the body and revolvable about the axis, relative to the body.

3. The downhole drilling assembly of claim 2, further comprising one or more blades projecting radially from the sleeve and sloping away from the axis at increasing distances from the one or more first cutting elements.

4. The downhole drilling assembly of claim 2, further comprising one or more blades projecting radially from the sleeve; wherein a single third cutting element is secured to each of the blades.

5. The downhole drilling assembly of claim 1, wherein the one or more third cutting elements extend radially farther from the axis than the one or more first cutting elements.

6. The downhole drilling assembly of claim 1, wherein the one or more third cutting elements extend radially farther from the axis than the one or more second cutting elements when the one or more second cutting elements are fully retracted, and the one or more second cutting elements extend radially farther from the axis than the third cutting elements when they fully extended.

7. The downhole drilling assembly of claim 1, wherein the one or more third cutting elements are axially staggered.

8. The downhole drilling assembly of claim 1, wherein the one or more third cutting elements comprise three-dimensional distal geometries.

9. The downhole drilling assembly of claim 1, wherein the one or more third cutting elements are secured to a sleeve and the clutch or locking device is capable of engaging the sleeve with one or more mating teeth.

10. The downhole drilling assembly of claim 9, wherein the teeth comprise a geometry such that mating of the teeth rotationally aligns the sleeve relative to the body.

11. A method of downhole drilling, comprising:

rotating a body about an axis;

boring a generally cylindrical hole within a formation with one or more first cutting elements radially protruding from the body;

transforming the hole to a non-cylindrical shape by extending one or more second cutting elements radially from the body;

allowing one or more third cutting elements to freely revolve about the axis relative to the body; and sliding the one or more third cutting elements against the non-cylindrical hole shape while they are freely revolving relative to the body, wherein the one or more third cutting elements are configured to remain rotationally stationary with respect to the non-cylindrical hole shape while sliding.

12. The method of downhole drilling of claim 11, further comprising extending the one or more second cutting elements radially farther from the axis than the one or more third cutting elements while they are revolving.

13. The method of downhole drilling of claim 11, further comprising:

restraining the one or more third cutting elements from revolving about the axis relative to the body; and reaming the hole back to a cylindrical shape with the one or more third cutting elements.

14. The method of downhole drilling of claim 13, further comprising retracting the one or more second cutting elements radially closer to the axis than the one or more third cutting elements while they are restrained from revolving.

15. The method of downhole drilling of claim 13, wherein restraining the one or more third cutting elements comprises aligning them relative to the body.

16. The method of downhole drilling of claim 13, wherein restraining the one or more third cutting elements comprises engaging a clutch or locking device capable of rotationally fixing the one or more third cutting elements relative to the body.

17. The method of downhole drilling of claim 11, wherein the one or more third cutting elements comprise three-dimensional distal geometries.

18. The method of downhole drilling of claim 11, wherein the one or more third cutting elements are axially staggered on a sleeve about the body.

19. The method of downhole drilling of claim 11, wherein extending the one or more second cutting elements radially from the body comprises translating a piston radially from the body, wherein the one or more second cutting elements are secured to the piston.

* * * * *